US006016755A

United States Patent [19]

Trapani

[11] Patent Number: 6,016,755

[45] Date of Patent: Jan. 25, 2000

[54] KEYBOARD SUPPORT AND METHOD FOR USING KEYBOARD

[76] Inventor: Charles J. Trapani, 234 Indian Hollow Ct., Mahwah, N.J. 07430

[21] Appl. No.: 09/165,938

[22] Filed: Oct. 2, 1998

[51] Int. Cl.[7] ..... A47B 83/00

[52] U.S. Cl. ..... 108/50.01; 108/6; 312/208.1

[58] Field of Search ..... 108/50.01, 50.02, 108/5, 6; 312/223.3, 208.1; 248/284.1, 918, 291.1

[56] References Cited

U.S. PATENT DOCUMENTS

| | | | |
|---|---|---|---|
| 4,625,657 | 12/1986 | Little et al. . | |
| 4,640,199 | 2/1987 | Zigman . | |
| 4,691,888 | 9/1987 | Cotterill . | |
| 5,037,054 | 8/1991 | McConnell . | |
| 5,101,736 | 4/1992 | Bommarito et al. . | |
| 5,176,351 | 1/1993 | Moore . | |
| 5,287,815 | 2/1994 | Gross . | |
| 5,294,087 | 3/1994 | Drabczyk et al. . | |
| 5,487,525 | 1/1996 | Drabczyk et al. . | |
| 5,490,466 | 2/1996 | Diffrient . | |
| 5,611,608 | 3/1997 | Clausen . | |
| 5,671,091 | 9/1997 | Monroe et al. | 108/6 X |
| 5,694,861 | 12/1997 | Laukamm-Josten | 108/50.01 |
| 5,699,225 | 12/1997 | Yavitz et al. | 108/50.01 X |
| 5,758,934 | 6/1998 | Flutka et al. | 108/50.01 X |

*Primary Examiner*—Anthony Knight
*Assistant Examiner*—Karlena D. Schwing
*Attorney, Agent, or Firm*—R. Neil Sudol; Henry D. Coleman

[57] ABSTRACT

A support for a computer or data entry keyboard includes a frame member having a pair of opposite sides disposed in a plane, a main platform member pivotably mounted to the frame member along one of the sides, and an auxiliary platform member pivotably mounted to the frame member along the other of the sides. Cooperating connectors such as hooks, pins, locks, latches, snaps, etc., releasably couple the main platform member and the auxiliary platform member to one another when both the main platform member and the auxiliary platform member are pivoted in a common direction out of the plane.

20 Claims, 4 Drawing Sheets

KEYBOARD SUPPORT AND METHOD FOR USING KEYBOARD

BACKGROUND OF THE INVENTION

This invention relates to a support for a computer or data-entry keyboard. This invention also relates to an associated method for using such a keyboard.

It is well know that intensive and continued use of computer keyboards can result in physical afflictions as Carpal Tunnel syndrome. Various proposals have been advanced to obviate, alleviate or eliminate Carpal Tunnel syndrome. Such proposals have include the redesign of computer keyboards, for example, by changing the disposition of the keys or by splitting the keyboard into two sections which are disposable at an angle relative to one another. Such solutions have not proven popular with users. Not only are the costs of these alternative designs higher than conventional keyboards, but users find it burdensome or difficult to change to new key positions.

OBJECTS OF THE INVENTION

An object of the present invention is to provide a method of using a conventional computer or data-entry-type keyboard which reduces the incidence of repetitive stress symptoms such as Carpal Tunnel syndrome.

Another object of the present invention is to provide a support for computer or data-entry-type keyboards which reduces the incidence of repetitive stress symptoms such as Carpal Tunnel syndrome.

A further object of the present invention is to provide such a support which is simple and easy to sue.

Yet another object of the present invention is to provide such a support which is inexpensive.

These and other objects of the present invention will be apparent from the drawings and descriptions herein.

SUMMARY OF THE INVENTION

A support for a computer or data entry keyboard comprises, in accordance with the present invention, a frame member having a pair of opposite sides disposed in a plane, a main platform member pivotably mounted to the frame member along one of the sides, an auxiliary platform member pivotably mounted to the frame member along the other of the sides, and means for releasably connecting the main platform member and the auxiliary platform member to one another when both the main platform member and the auxiliary platform member are pivoted in a common direction out of the plane.

The frame member is preferably rectangular and provided with a rectangular opening defined by a pair of elongate elements, the main platform member and the auxiliary platform member being disposed in the opening and aligned with the frame member in the plane of the frame member. In this case, the main platform member and the auxiliary platform member overlap and are substantially coextensive with one another in the opening.

The support can be used as a desk-top type surface, holding a keyboard in a substantially horizontal plane. When a user desires to use the support surface for orienting the keyboard at an angle relative to a horizontal plane, a mirror mounted to the auxiliary platform member on a major surface thereof facing the main platform member facilitates viewing of the keyboard.

In accordance with another feature of the present invention, a cover may be provided which is disposable over the keyboard upon placement thereof on the main platform member. The cover is provided with mirror images of keyboard characters and symbols so that the cover reflected in the mirror provides a proper, readable image of the keyboard characters and symbols.

In accordance with a further feature of the present invention, an arrest is provided on the main platform member for retaining a keyboard on the main platform member, in opposition to a force exerted by gravity, when both the main platform member and the auxiliary platform member are pivoted in the common direction out of the plane. The arrest may be pivotably connected to the main platform member, so that the arrest may be swung into alignment with the main platform when not in use.

The connecting of the main platform member and the auxiliary platform member may be implemented by a lock, a latch, a hook, a pin, a snap, or hook and loop member (VELCRO™). In addition, means may be provided for connecting the main platform member and the auxiliary platform member at a selectably different angle to one another when both the main platform member and the auxiliary platform member are pivoted in a common direction out of the plane.

A support for a computer or data entry keyboard comprises, in accordance with another embodiment of the present invention, a frame member having a pair of opposite sides disposed in a first plane, a first support member on the frame member for supporting a keyboard in a second plane oriented at an angle relative to the first plane, and a second support member on the frame member for supporting a mirror to enable visualization of the keyboard by a user when the keyboard is disposed in the second plane. Preferably, a connector is provided for releasably connecting the first support member and the second support member to one another when the first support member is oriented to support the keyboard in the second plane.

As discussed above, the frame member may be rectangular and provided with a rectangular opening, the first support member and the second support member being disposed in the opening and aligned with the frame in the plane. More specifically, the support members may include respective plates or boards which overlap and are substantially coextensive with one another in the opening. Again, a cover may be disposed over the keyboard placed on the first support member, the cover being provided with mirror images of keyboard characters and symbols so that the cover reflected in the mirror forms a proper, readable image of the keyboard characters and symbols.

A method for using a computer or data-entry keyboard comprises, in accordance with the present invention, providing a support including a frame member and a platform member pivotably attached to the frame member, orienting the platform member at an angle relative to a plane of the frame member, and disposing the keyboard on the platform member to thereby orient the keyboard at that angle relative to the frame member plane after the orienting of the platform member. While the keyboard is disposed at the angel relative to the plane, the keyboard is viewed via a mirror provided on the frame member and keys or pad areas on the keyboard are actuated.

The method may further comprise a step of disposing a cover over the keyboard on the platform member, the cover being provided with mirror images of keyboard characters and symbols so that the cover reflected in the mirror forms a proper, readable image of the keyboard characters and symbols. The user views the images in the mirror of the image-reversed characters and symbols on the cover over keyboard.

DESCRIPTION OF THE PREFERRED EMBODIMENTS

Figure 1:
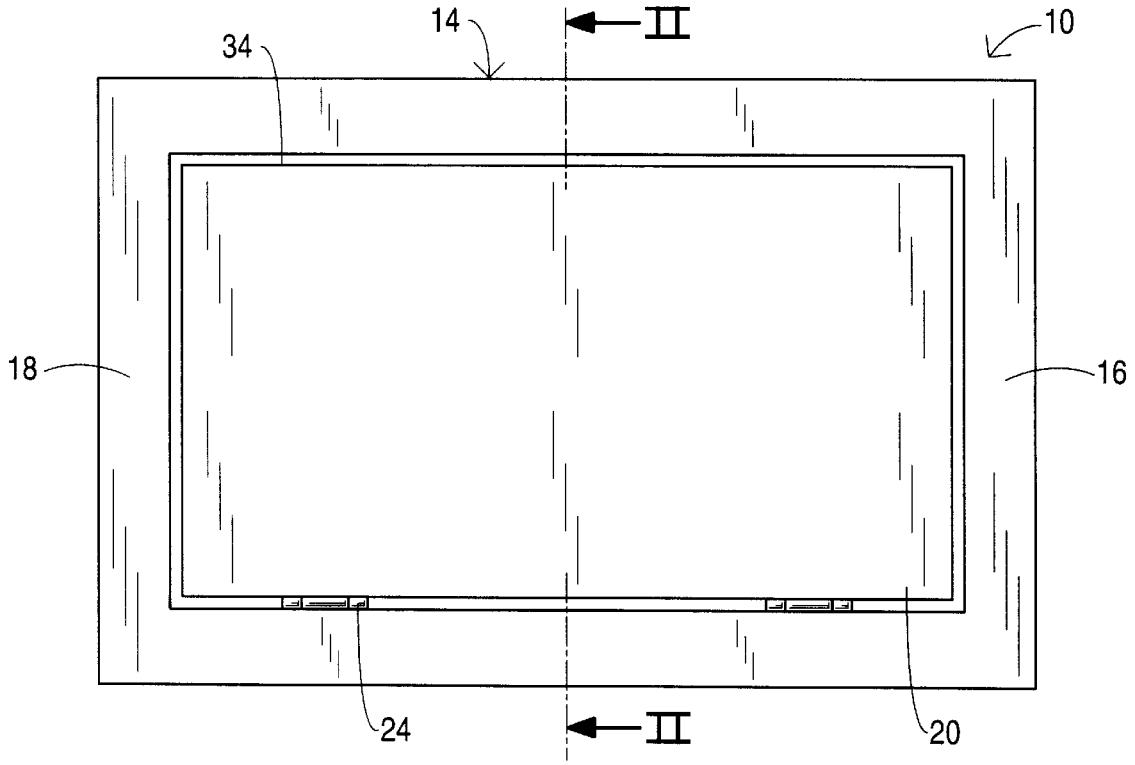
FIG. 1 is a schematic top plan view of a computer keyboard support in accordance with the present invention showing the keyboard support in a closed or planar configuration.
Figure 2:
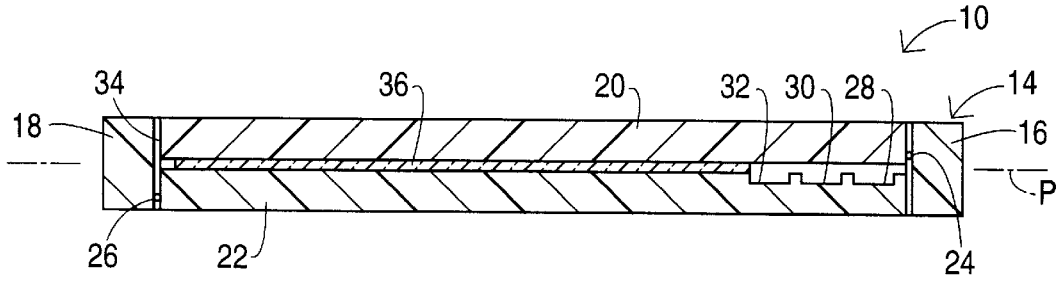
FIG. 2 is a schematic cross-sectional view, on a slightly reduced scale, taken along line II—II in FIG. 1.
Figure 3:
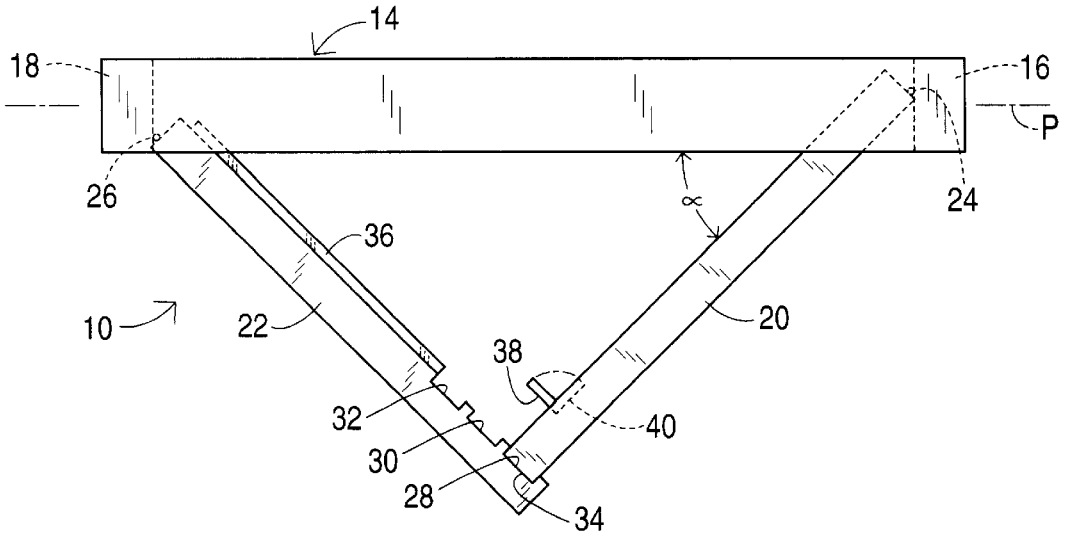
FIG. 3 is a side elevational view, on a larger scale, of the keyboard support of FIGS. 1 and 2 showing the support in a folded out, use configuration.

As illustrated in FIGS. 1–3, a support 10 for a computer or data entry keyboard 12 (FIG. 4) comprises a rectangular frame 14 defining a rectangular opening 16. Frame 14 has a pair of elongate structural members 16 and 18 which form opposite sides of opening 16. Structural members 16 and 18 are disposed in a plane P. A main platform member 20 is pivotably mounted along one side of frame 14 and particularly to structural member 16, while an auxiliary platform member 22 is pivotably mounted along the opposite side to frame 14, to structural member 18.

FIGS. 1 and 2 show the keyboard support in a closed configuration in which platform members 20 and 22 are disposed in opening 16 and are aligned with frame 14 in plane P. In this configuration, platform members 20 and 22 overlap and are substantially coextensive and parallel with one another in opening 16.

Upper or main platform member 20 is connected to structural member 16 via one or more hinges 24, while lower or auxiliary platform member is secured to structural member 18 via one or more hinges 26. Hinges 24 and 26 may be spring loaded for biasing platform members 20 and 22 upwardly into the closed configuration of FIGS. 1 and 2.

As illustrated in FIG. 3, platform members 20 and 22 may be swung out of opening 16 and away from plane P to form a folded-out use configuration. Auxiliary platform member 22 is provided at a free end, opposite structural member 18 and hinges 26, with a plurality of elongate grooves 28, 30 and 32 for alternately receiving a free end 34 of platform member 20. Platform member 20 is oriented at an angle $\alpha$ relative to plane P, the magnitude of that angle varying depending on whether free end 34 of the main platform member is inserted into groove 28, 30 or 32 of auxiliary platform member 22.

Figure 4:
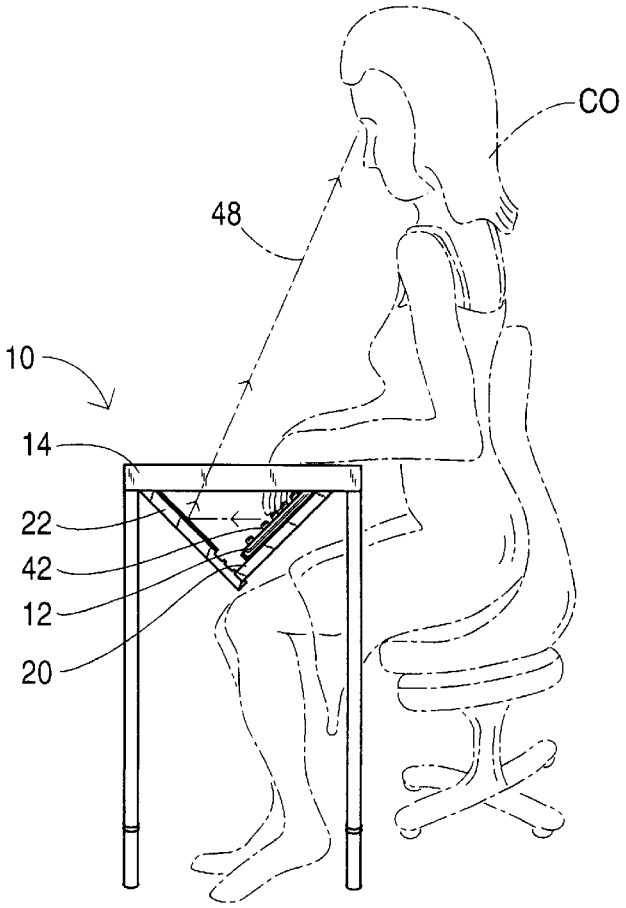
FIG. 4 is a schematic side elevational view of a person using the keyboard support of FIGS. 1–3, showing the keyboard support in the folded-our configuration of FIG. 3 and a keyboard disposed on the support.

An upper surface of auxiliary platform member 22, facing main platform member 20, is provided with a mirror 36 for facilitating a visual monitoring of keyboard 12 during use (see FIG. 4). An upper surface of main platform member 20 is provided with one or more arrests 38 (FIG. 3) for retaining keyboard 12 on the main platform member, in opposition to a force exerted by gravity, when platform members 20 and 22 are pivoted in a common direction (generally downwardly) out of opening 16 and away from plane P. Arrests 38 are pivotably connected to main platform member 20, so that the arrests may be swung into alignment with the main platform member when not in use. One or more recesses 40 may be provided in main platform member 20 for receiving respective arrests 38.

In using the keyboard support 10, a computer operator CO (FIG. 4) pivots platform members 20 and 22 downwardly out of opening 16 and away from plane P. Free end 34 of main platform member 20 is inserted into a selected groove 28, 30 or 32 in auxiliary platform member 22. The orientation angle $\alpha$ (FIG. 3) of main platform member 20 may be adjusted according to the needs of the individual operator CO by shifting free end 34 of platform member 20 from one groove 28, 30 or 32 to another. Arrest or arrests 38 are pivoted out of respective recesses 40. Subsequently, keyboard 12 is placed on main platform member 20 in contact with arrests 38. While keyboard 12 is disposed at angle $\alpha$ relative to plane P, the operator CO views the keyboard via mirror 36 and pushes keys or pad area 42 on keyboard 12.

Figure 5:
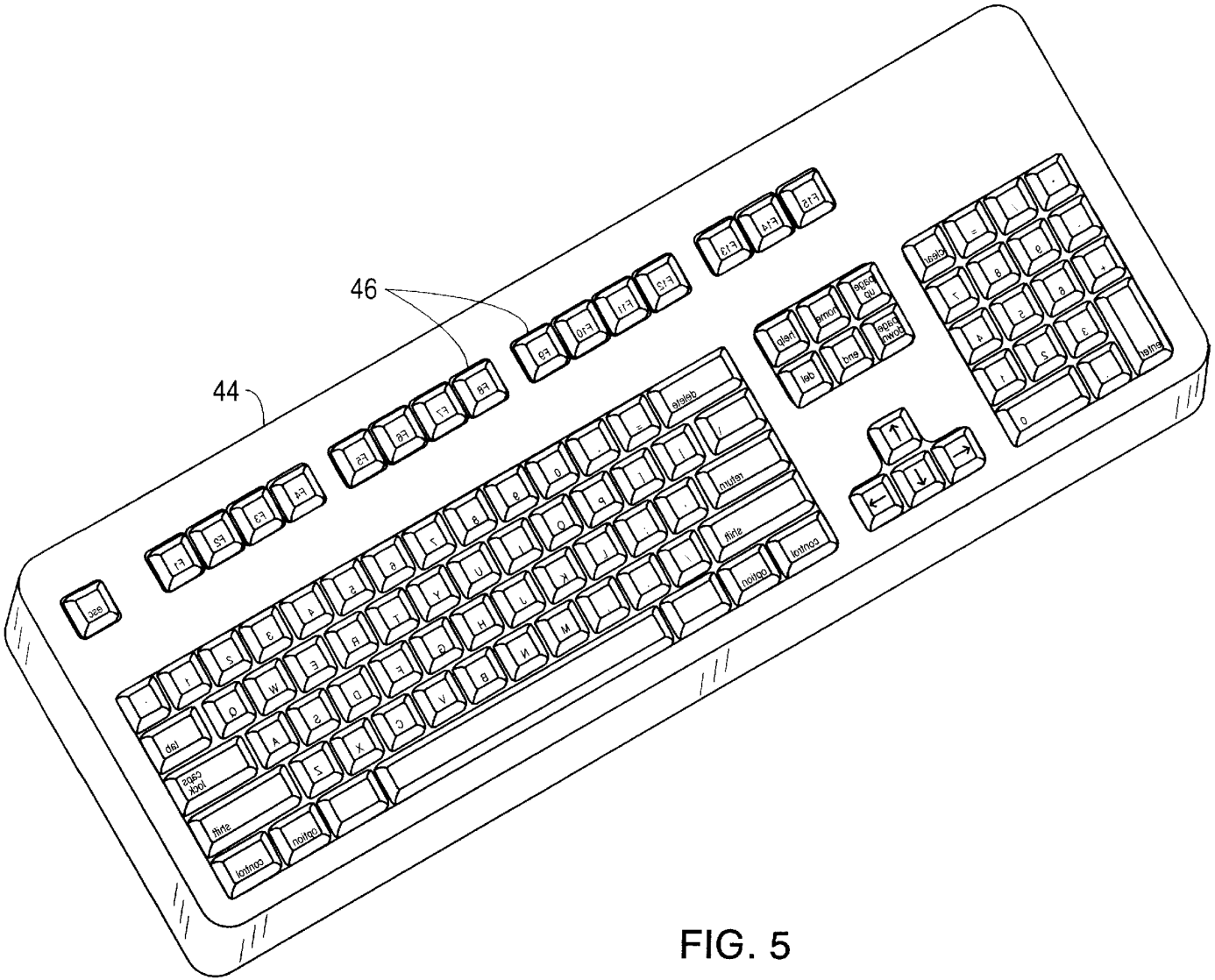
FIG. 5 is a schematic perspective view of a keyboard cover used with the keyboard support of FIGS. 1–3.

In order to facilitate the perception of alphanumeric characters and other typographical symbols on keyboard 12, a keyboard cover 44 (FIG. 5) is provided. Cover 44 has mirror images 46 of keyboard characters and symbols. Operator CO disposes cover 44 over keyboard 12 on main platform member 20 and subsequently views keyboard 12 and cover 44 in mirror 36, as indicted by a sight line 48. The images of the reversed character and symbol images 46 in mirror 36 are themselves reversed and therefore perceptible as normally oriented alphanumeric characters and typographical symbols.

In order to ensure a secure connection of main platform member 20 and auxiliary platform member 22 in the folded-out use configuration (FIG. 3), i.e., to releasably connect main platform member 20 and auxiliary platform member 22 to one another when both platform members are pivoted out of opening 16 away from plane P, a connector or cooperating connector elements are provided. These connector elements may take any of a number of equivalent forms, several of which are illustrated in FIGS. 6–10.

Figure 6:
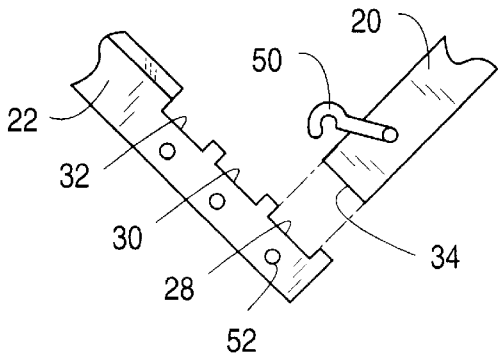
FIG. 6 is a schematic partial side elevational view of a keyboard support in accordance with the present invention, showing a first releasable connector for releasably coupling two members of the keyboard support

As illustrated in FIG. 6, a hook 50 pivotably mounted to one platform member 20 engages a pin 51 projecting laterally from the other platform member 22 to hold the ends of the platform members together during use of the keyboard support 10.

Figure 7:
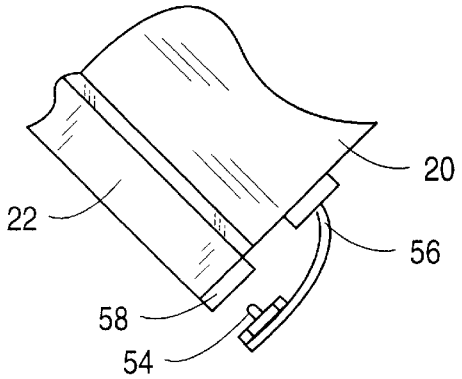
FIG. 7 is a schematic partial front elevational view of the keyboard support, showing a second releasable connector for releasably coupling two members of the keyboard support.

As depicted in FIG. 7, a ball snap-lock element 54 attached via a flexible web 56 to one platform member 20 cooperates with a socket element 58 attached to the other platform member 22 to maintain the ends of the platform members together during use of the keyboard support 10.

Figure 8:
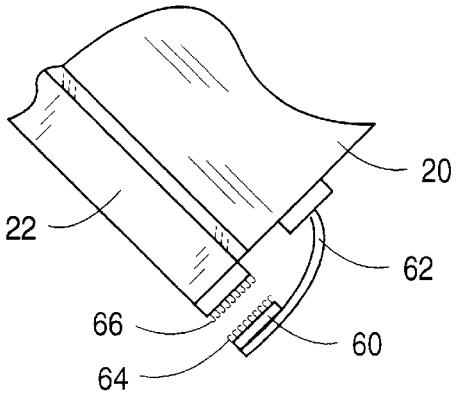
FIG. 8 is a schematic partial front elevational view of the keyboard support, showing another releasable connector for releasably coupling two members of the keyboard support.

FIG. 8 shows a hook element 60 on a strap 62 joined to one platform member 20. Hook element 60 has a multitude of tiny polymeric hooks 64 which seize a loop element 66 attached to the other platform member 22, thereby locking the platform members 20 and 22 to one another. Hook element 60 and loop element 66 are commonly known as VELCRO™.

Figure 9:
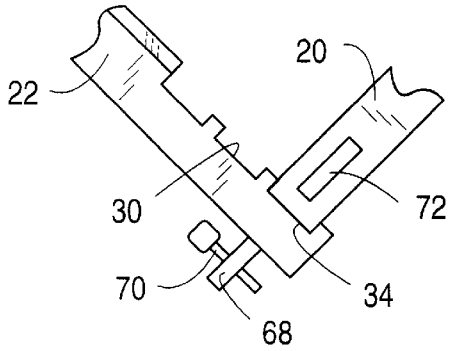
FIG. 9 is a schematic partial side elevational view of the keyboard support, showing a further releasable connector for releasably coupling two members of the keyboard support.

Another pair of cooperating connecting elements, namely, a spring loaded sliding pin 68 and a locking pin 70, are illustrated in FIG. 9. Sliding pin 68 is reciprocatably mounted to one platform member 20 and is provided with an aperture (not shown) traversed by the locking pin 70. Sliding pin 68 is provided with a knob or handle 72, whereby operator CO shifts the sliding pin out of platform member 20, in opposition to a spring force tending to return the pin to platform member 20. Sliding pin 68 is shifted through a hold (not illustrated) in platform member 22, at the bottom of a groove 28, 30, 32.

Figure 10:
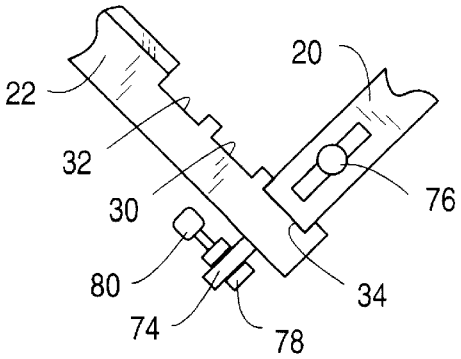
FIG. 10 is a schematic partial side elevational view of the keyboard support, showing yet another releasable connector for releasably coupling two members of the keyboard support.

As shown in FIG. 10, another sliding pin 74 with an actuator knob 76 is locked in an extended position by a C clamp 78 including a set screw 80.

The connecting elements of FIGS. 6–10 are not necessary in cases where hinges 24 and 26 are provided with strong restoring springs.

Support 10 can be used as a desk-top type surface, holding a keyboard in a substantially horizontal plane. When operator CO desires to use the support for varying the angle $\alpha$ of keyboard 12 relative to horizontal plane P, mirror 36 facilitates viewing of the keyboard.

Although the invention has been described in terms of particular embodiments and applications one of ordinary skill in the art, in light of this teaching, can generate additional embodiments and modifications without departing from the spirit of or exceeding the scope of the claimed invention. For example, frame 14 may have a shape other than rectangular. More specifically, frame 14 may be incorporated in a piece of furniture such as a desk. Accordingly, it is to be understood that the drawings and descriptions herein are proffered by way of example to facilitate comprehension of the invention and should not be construed to limit the scope thereof.

What is claimed is:

1. A support for a computer or data entry keyboard, comprising:

a frame member having a pair of opposite sides disposed in a plane;

a main platform member pivotably mounted to said frame member along one of said sides;

an auxiliary platform member pivotably mounted to said frame member along the other of said sides; and means for releasably connecting said main platform member and said auxiliary platform member to one another when both said main platform member and said auxiliary platform member are pivoted in a common direction out of said plane.

2. The support defined in claim 1 wherein said frame member is provided with a rectangular opening, said main platform member and said auxiliary platform member being disposed in said opening and aligned with said frame member in said plane in a planar configuration of the support, said main platform member and said auxiliary platform member extending out of said plane in an angled or substantially wedge-shaped configuration of the support.

3. The support defined in claim 2 wherein said main platform member and said auxiliary platform member overlap and are substantially coextensive with one another in said opening in said planar configuration of the support.

4. The support defined in claim 3, further comprising a mirror mounted to said auxiliary platform member on a major surface thereof facing said main platform member.

5. An assembly for facilitating use of a computer keyboard, comprising the support defined in claim 4, further comprising a cover disposable over said computer keyboard upon a placement of said computer keyboard on said main platform member and upon a pivoting of said main platform member and said auxiliary platform member out of said plane to form said angled or substantially wedge-shaped configuration of the support, said cover being provided with mirror images of keyboard characters and symbols so that said cover reflected in said mirror forms a proper, readable image of the keyboard characters and symbols in said angled or substantially wedge-shaped configuration of the support.

6. The support defined in claim 3 wherein said frame member includes a pair of elongate elements defining said opposite sides of said frame member and opposite sides of said opening.

7. The support defined in claim 1, further comprising an arrest on said main platform member for retaining a keyboard on said main platform member, in opposition to a force exerted by gravity, when both said main platform member and said auxiliary platform member are pivoted in said common direction out of said plane.

8. The support defined in claim 7 wherein said arrest is pivotably connected to said main platform member.

9. The support defined in claim 1, further comprising a mirror mounted to said auxiliary platform member on a major surface thereof facing said main platform member.

10. An assembly for facilitating use of a computer keyboard, comprising the support defined in claim 9, further comprising a cover disposable over said computer keyboard upon a placement of said computer keyboard on said main platform member and upon a pivoting of said main platform member and said auxiliary platform member out of said plane to form an angled or substantially wedge-shaped configuration of the support, said cover being provided with mirror images of keyboard characters and symbols so that said cover reflected in said mirror forms a proper, readable image of the keyboard characters and symbols in said angled or substantially wedge-shaped configuration of the support.

11. The support defined in claim 1 wherein said means for connecting includes an element taken from the group including a lock, a latch, a hook, a pin, a snap, and hooks and loops.

12. The support defined in claim 1 wherein said means for releasably connecting includes means for coupling said main platform member and said auxiliary platform member at a selectably different angle to one another when both said main platform member and said auxiliary platform member are pivoted in said common direction out of said plane.

13. A support for a computer or data entry keyboard, comprising:

a frame member having a pair of opposite sides disposed in a first plane;

first support means on said frame member for supporting a keyboard in a second plane oriented at an angle relative to said first plane; and second support means on said frame member for supporting a mirror to enable visualization of the keyboard by a user when said keyboard is disposed in said second plane.

14. The support defined in claim 13 wherein said first support means is movably connected to said frame member so as to be alternately disposable in a first position and in said second plane, said second support means being movably connected to said frame member so as to be alternately disposable in two positions, further comprising connecting means for releasably connecting said first support means and said second support means to one another when said first support means is oriented to support the keyboard in said second plane.

15. The support defined in claim 13 wherein said first support means is movably connected to said frame member so as to be alternately disposable in a first position and in said second plane, said second support means being movably connected to said frame member so as to be alternately disposable in two positions, said frame member being rectangular and provided with a rectangular opening, said first support means being disposed in said opening and aligned with said frame member in said plane in said first position, said second support means being disposed in said opening and aligned with said frame member in said plane in one of said two positions.

16. The support defined in claim 15 wherein said first support means includes a first plate or board member and said second support means includes a second plate or board member, said first plate or board member and said second plate or board member overlapping and being substantially coextensive with one another in said opening in said first position of said first support means and one of said two positions of said second support means.

17. An assembly for facilitating use of the keyboard, comprising the support defined in claim 15, further comprising a cover disposable over said keyboard placed on said first support means, said cover being provided with mirror images of keyboard characters and symbols so that said cover reflected in said mirror forms a proper, readable image of the keyboard characters and symbols when said first support means is in said second position and said second support means is in another of said two positions.

18. The support defined in claim 13 wherein said first support means is movably connected to said frame member so as to be pivotably from a first position in said first plane and a second position in said second plane, said second support means being movably connected to said frame member so as to be alternately disposable in a third position in said first plane and a fourth position, further comprising an arrest on said first support means for retaining the keyboard on said first support means, in opposition to a force exerted by gravity, when both said first support means and said second support means are pivoted in a common direction out of said first plane.

19. A method for using a computer or data-entry keyboard, comprising:

providing a support including a frame member and a platform member movably attached to said frame member;

orienting said platform member at an angle relative to a plane of said frame member;

disposing a keyboard on said platform member, whereby said keyboard is disposed at said angle relative to said plane after the orienting of said platform member;

while said keyboard is disposed at said angle relative to said plane, viewing a reflection of said keyboard in a mirror provided on said frame member; and while said keyboard is disposed at said angle relative to said plane, actuating keys or pad areas on said keyboard.

20. The method defined in claim 19, further comprising disposing a cover over the keyboard on said platform member, said cover being provided with mirror images of keyboard characters and symbols so that said cover reflected in said mirror forms a proper, readable image of the keyboard characters and symbols.

* * * * *